US007601073B2

(12) United States Patent
Henry

(10) Patent No.: US 7,601,073 B2
(45) Date of Patent: Oct. 13, 2009

(54) GOLF PUTTER

(75) Inventor: David Vincent Henry, Seymour, TN (US)

(73) Assignee: MPH Golf, LLC, Knoxville, TN (US)

( * ) Notice: Subject to any disclaimer, the term of this patent is extended or adjusted under 35 U.S.C. 154(b) by 235 days.

(21) Appl. No.: 11/697,756

(22) Filed: Apr. 9, 2007

(65) Prior Publication Data

US 2008/0248894 A1 Oct. 9, 2008

(51) Int. Cl.
*A63B 69/36* (2006.01)
*A63B 53/04* (2006.01)

(52) U.S. Cl. ..... 473/249; 473/251; 473/340; 473/253

(58) Field of Classification Search ..... 473/219–256, 473/324–350, 282–292; D21/736–746
See application file for complete search history.

(56) References Cited

U.S. PATENT DOCUMENTS 1,960,110 A * 5/1934 Iles ..... 473/286
3,408,074 A 10/1968 Antonious
3,632,112 A 1/1972 Jacobs
3,708,172 A 1/1973 Rango
3,779,398 A * 12/1973 Hunter ..... 473/249
3,841,639 A 10/1974 Werner
3,841,640 A * 10/1974 Gaulocher ..... 473/249
D257,869 S 1/1981 MacDougall
4,580,784 A 4/1986 Brill
4,934,702 A 6/1990 Serizawa
D342,558 S * 12/1993 Diesterheft ..... D21/741
5,388,827 A * 2/1995 Reynolds, Jr. ..... 473/306
5,417,426 A 5/1995 Bayer
D364,666 S 11/1995 Nagy
D388,853 S 1/1998 Minami
5,725,441 A * 3/1998 Jensen et al. ..... 473/251
D402,724 S 12/1998 Minami
D424,145 S 5/2000 Minami
6,379,258 B1 4/2002 To
6,435,975 B2 8/2002 Middleton
D470,904 S * 2/2003 Tang et al. ..... D21/742
6,634,955 B2 * 10/2003 Middleton ..... 473/231
6,692,378 B2 * 2/2004 Shmoldas et al. ..... 473/340
6,702,688 B2 3/2004 Hale
6,863,617 B2 * 3/2005 Park ..... 473/226
6,878,071 B1 * 4/2005 Schwieger et al. ..... 473/284
6,878,072 B1 4/2005 Henry
6,905,420 B2 * 6/2005 Tang et al. ..... 473/242
7,059,971 B1 * 6/2006 Schmitt ..... 473/285
7,086,959 B2 * 8/2006 D'Agguano ..... 473/282
7,198,574 B2 * 4/2007 Barbosa ..... 473/286
7,255,650 B2 * 8/2007 Braynt et al. ..... 473/252

(Continued)

*Primary Examiner*—Sebastiano Passaniti
(74) *Attorney, Agent, or Firm*—Pitts & Brittian, P.C.

(57) ABSTRACT

A golf putter head dimensioned to closely simulate the size of a regulation-sized golf hole and including at least an indicium approximating the size of a golf ball, whereby a golfer is presented with a visual representation of the size of the target at which he/she is aiming. The golf putter head further indicia for indicating a direction of initial travel of the ball. Further, the golf putter head includes three-dimensional indicia to assist the golfer in properly aligning his/her eyes and hands above the golf putter head while addressing the golf ball to be struck. When the golfer is in a proper stance the three-dimensional indicia substantially "disappear."

4 Claims, 4 Drawing Sheets

U.S. PATENT DOCUMENTS

| | | | | |
|---|---|---|---|---|
| 7,281,987 | B2 * | 10/2007 | Iwade | 473/314 |
| 7,393,285 | B2 * | 7/2008 | Stellander | 473/251 |
| 2005/0059506 | A1 | 3/2005 | Yamamoto | |
| 2005/0096153 | A1 | 5/2005 | Stoakes | |
| 2005/0176520 | A1 | 8/2005 | Henry | |
| 2008/0176666 | A1 * | 7/2008 | Witkoski | 473/219 |

* cited by examiner

GOLF PUTTER

CROSS-REFERENCE TO RELATED APPLICATIONS

Not Applicable.

STATEMENT REGARDING FEDERALLY SPONSORED RESEARCH OR DEVELOPMENT

Not Applicable

BACKGROUND OF THE INVENTION

1. Field of Invention

The present invention pertains to the field of golf putters. More particularly, this invention is a golf ball putter head having golf ball alignment indicia for assisting a golfer in aligning the golf ball with respect to the putter head prior to putting.

2. Description of the Related Art

In the field of golf, great emphasis is placed on putting. Many putting aides have been provided for assisting a golfer in aligning a putter with the ball relative to the hole. While many factors must be considered when aligning the putter, one aspect that is often overlooked is the visual misconception of the size of the cup.

It is well known, for example, to consider the lie of the ball relative to the cup. A golfer will investigate whether there is an uphill or downhill lie. The golfer will further investigate whether the green is sloping in a direction where the ball will travel across a slope, thereby requiring the golfer to aim away from the cup such that the ball will travel in an arcuate path to come back to the hole. The golfer will also investigate the direction of the turf, the moisture of the turf, and whether there are in other obstacles between the ball and the cup.

It is known to provide indicia of various configurations to assist the golfer in aligning the putter head with the golf ball and to aim the face of the club, and thereby the travel path of the putter, relative to the results of the various aspects of investigation mentioned above.

Several putters have been provided in the prior art. Typical of the art are those devices disclosed in the following U.S. patents and published applications:

| U.S. Pat. No. | Inventor(s) | Issue Date |
|---|---|---|
| D257,869 | A. S. O. MacDougall | Jan. 13, 1981 |
| D364,666 | E. Nagy | Nov. 28, 1995 |
| D388,853 | R. W. Minami | Jan. 6, 1998 |
| D402,724 | R. W. Minami | Dec. 15, 1998 |
| D424,145 | R. W. Minami | May 2, 2000 |
| 3,408,074 | A. J. Antonious | Oct. 29, 1968 |
| 3,632,112 | C. D. Jacobs | Jan. 4, 1972 |
| 3,708,172 | J. F. Rango | Jan. 2, 1973 |
| 3,841,639 | F. D. Werner | Oct. 15, 1974 |
| 4,580,784 | E. F. Brill | Apr. 8, 1986 |
| 4,934,702 | S. Serizawa | Jun. 19, 1990 |
| 5,417,426 | S. L. Bayer | May 23, 1995 |
| 6,379,258 | S. To | Apr. 30, 2002 |
| 6,435,975 | N. M. Middleton | Aug. 20, 2002 |
| 6,702,688 | B. R. Hale | Mar. 9, 2004 |
| 6,878,072 | D. V. Henry | Apr. 12, 2005 |
| **Publication No.** | **Inventor(s)** | **Publication Date** |
| 2005/0096153 | N. L. Stoakes | May 5, 2005 |
| 2005/0059506 | J. Yamamoto | Mar. 17, 2005 |
| 2005/0176520 | D. V. Henry | Aug. 11, 2005 |

Of these patents, the '869 design patent issued to MacDougall illustrates a golf club head defining planar parallel top and bottom surfaces. A cylindrical opening is vertically oriented and centrally disposed in the club head. The club head defines a planar face and a semicircular trailing edge. A sighting line is illustrated in the center of the club head, extending from the face to the heel.

Similarly, the '666 design patent issued to Nagy defines a triangular club head having a centrally disposed opening. However, Nagy illustrates a curved bottom surface. Further, the centrally disposed opening defines a substantially hemispherical configuration. A sight line is illustrated in the center of the club head, extending from the face to the opening.

Minami ('853 design, '724 design and '145 design) discloses several golf putter heads configured to retrieve a golf ball. Each club head defines a through opening defining a substantially cylindrical side wall through which the golf ball is received. Sight lines are also disclosed in various configurations.

Antonious, in the '074 patent, discloses a putter provided with a weighted spherical section of the same shape and size as a golf ball. The spherical section is rigid with the top of the putter head and positioned on a line where the putter contacts the ball. The spherical section is cut at a rearward angle to a vertical plane so that when viewed from above the cut sector presents alignment indicia.

In his '639 patent, Werner discloses a golf ball retrieving club. The golf putter of the '639 patent includes a head of a size and shape to be received within a golf cup and defines a receptacle in the bottom of the putter head configured to receive and hold a golf ball. Werner incorporates a flexible tubular member for retaining the golf ball in the golf ball receptacle. A "T" shaped sighting indicia is provided. A first sighting line is parallel to and spaced apart from the face of the club head. A second sighting line it disposed orthogonally to the first sighting line, and extends from approximately the center of the first sighting line to approximately the heel of the club head. Werner discloses that the sighting lines are recesses and may be painted with a contrasting color.

In his '112 patent, Jacobs discloses a golf ball retrieving club defining a gall ball holding cavity extending completely through the putter head and further opening on the rear wall of the club head. The wall of the cavity is tapered inward from the bottom to the top to compress a golf ball when received therein. In order to aid in aligning the club head with the ball and with the cup into which the ball is to be stroked, parallel sight lines in the form of grooves are provided on the top surface, normal to the striking face.

Rango, in his '172 patent, discloses a golf putter having a generally vertically extending opening having a circular cross section extending entirely through the head. The hole is dimensioned to match or be slightly greater than the diameter of a golf ball and is provided for dividing the head into substantially equal masses in order to counterbalance tendencies of the head to twist when the ball is struck at a location other than the center of the head. The hole is further provided to serve as a gauge for measuring the diameter of a ball, and to detect the roundness of a ball. A sighting mark in the top wall includes a forward sight groove and a rearward sight groove. The sight mark is perpendicular to the striking face.

Brill ('784) discloses a golf club capable of retreiving a golf ball by frictionally gripping the ball, or by scooping the ball from a surface. The head of the golf club includes a front section having a front face adapted to strike a golf ball, and a pair of side sections extending rearwardly from the front section. The top surface of the front section is provided with a pair of guide or aiming lines. When viewing from the top, the aiming lines assist in aiming and centering the ball.

Serizawa, in his '702 patent, discloses a putter for enabling picking up a ball within a hole in a standing posture. The putter head defines a circular hollow portion adapted to receive a golf ball by pushing the club downward on the ball. The elasticity of the surface of the ball and the friction between the ball and an inner peripheral edge of the circular hollow portion of the head abutting the elastic surface of the ball serve to retain the ball. In order to allow for effective putting of a ball more easily and accurately, a thin plated bridge is integrally formed in the head and a centered line is provided for sighting.

In the '426 patent, Bayer discloses a golf putter having ball retrieval and ball marking features. The '426 putter defines a through opening having a side wall tapering in from the bottom to a distance above the bottom, then tapering out from to the top. A reduced diameter is defined at the point the taper changes direction. A ball may be passed through the reduced diameter and received in the upper portion of the opening. The opening on the top surface of the putter head is thus larger than the diameter of a golf ball.

To, in the '258 patent, discloses a golf club with alignment indicia and method of use of the same. The golf club includes a club head which has a top and a striking face. The alignment indicia are in the form of a first straight line and a second straight line positioned in spaced apart relation on the top of the club head. The first straight line and the second straight line diverge as they approach the striking face. The first straight line is closer to the shaft than the second straight line. By selecting the first straight line or the second straight line for alignment, the striking face of the golf club is moved to an open or closed position to aid in intentional placement of the golf ball from the left or right toward a selected target.

Middleton ('975) discloses a golf club similar to that disclosed by Rango ('172). The club head defines a recess for receiving a golf ball used to practice alignment between the club head and a ball in play. The top surface further defines a rectangular recess from the face to the heel, with parallel elongated sides on either side of the golf ball recess.

In the '688 patent, Hale discloses a golf putter training system for developing a controlled putter head velocity and acceleration during a putting swing. The golf putter training system includes a body having a rear portion and a front portion, and a main aperture within the body for receiving a conventional golf ball in a rotatable manner. A direction indicium is positioned within an upper surface of the body for indicating the desired direction of travel of the putter head. The direction indicium includes an arrow shaped structure or line structure or other indicia capable of indicating a desired direction. The direction indicia is positioned within the front portion of the body.

The '153 application filed by Stoakes discloses a golf putter including a club head having a body and a forward ball striking surface. A weight-receiving pocket is formed in an upper surface of the body of the club head and a weight mounting device such as a screw is mounted within the weight-receiving pocket in the body of the club head. At least one club head weight is removably mounted within the weight-receiving pocket of the body of the club head by engagement with the weight mounting device, the club head weight including club head alignment indicia on the top face of club head weight operative to provide visual alignment cues for ball striking by the forward ball striking surface.

The '506 application filed by Yamamoto discloses a golf club putter head having a plurality of markings on the upper surface thereof. The markings include a half circle aligned with a spaced apart full circle, a first straight line parallel to the ball striking face and a second straight line along a diameter of the fill circle and extending through the half circle to intersect the first straight line at a point above the sweet spot of the ball striking face.

Finally, the '072 patent and the '520 application, both disclosed by the inventor of the present invention, disclose golf putters including a ball retriever and retainer configured to retrieve and hold a golf ball. The putter defines a substantially symmetrical configuration from heel to toe. Ball alignment indicia are disposed on the top surface of the golf putter head, the ball alignment indicia defining at least a C-shaped configuration, whereby a ball is visually aligned between said first and second ends to center the ball on said striking face. As disclosed in the '520 application, the ball alignment indicia may further include at least one line segment disposed coincidentally to the initial direction of travel of the golf ball.

BRIEF SUMMARY OF THE INVENTION

The present invention is a golf putter head dimensioned to closely simulate the size of a regulation-sized golf hole and including at least an indicium approximating the size of a golf ball, whereby a golfer is presented with a visual representation of the size of the target at which he/she is aiming in order to illustrate the size disparity between the ball and the hole. The golf putter head further includes indicia for indicating a direction of initial travel of the ball. Further, the golf putter head includes three-dimensional indicia to assist the golfer in properly aligning his/her eyes and hands above the golf putter head while addressing the golf ball to be struck.

The golf putter head defines a medial portion having a bottom surface that is substantially planar from the striking face and extending toward a heel portion. The club head defines a longitudinal axis perpendicular to the striking face, a transverse axis parallel to the striking face, and a vertical axis. The bottom surface of the heel portion defines a relief such that as the golf putter is moved through a stroke, the heel portion does not engage the putting surface. The lower perimeter of the golf putter head defines a radial groove having an inner diameter which, in the preferred embodiment, is smaller than the inside diameter of a golf cup. The radial groove is thus configured to receive the upper lip of the golf cup. Because the bottom surface of the heel portion defines a relief, the radial groove of the preferred embodiment is defined by a first radial groove and a second radial groove, each disposed on opposing sides of the striking face.

The golf putter head defines a substantially horizontal planar top surface. The trailing edge of the top surface defines a substantially rectangular recess. The recess is defined by substantially vertical sidewalls and a substantially horizontal bottom wall. The sidewalls include a first side wall disposed substantially parallel to the striking face. Second and third side walls are disposed substantially orthogonal to the first side wall. The first side wall is spaced from the striking face such that when a golfer is addressing a ball to be struck, the line of sight from the golfer's trailing eye is substantially co-planar with the first side wall. The second and third side walls are positioned with respect to center of the golf putter head such that when the golfer is addressing the ball, the line of sight from the golfer's trailing eye is also substantially co-planar with the second and third side walls. Therefore, when the golfer is in a neutral stance, when the golf putter head is positioned next to the ball to be struck, the first, second and third side walls each substantially "disappear."

In order to better accentuate the effect of the recess, the top surface of the golf putter head and the horizontal bottom wall may be painted or coated a first color, while the first, second and third side walls are painted or coated a second contrasting color.

Ball alignment indicia are provided on the top surface of the golf putter head. A circular indicium is illustrated as being concentric with the golf putter head and as defining a diameter closely simulating the diameter of a conventional golf ball. The circular indicium, in cooperation with the size of the golf putter head, serves to illustrate for the golfer the disparity between the relative size of the golf ball with respect to the hole. Linear indicia cooperate to define upper and lower limits of an initial path of travel of the golf ball. The linear indicia are closely spaced apart from the circular indicium in order to limit the visual margin of error in aligning the stroke.

The color of the golf putter head contrasts with the color of the circular indicium and the linear indicia. Accordingly, the golfer is provided a means to clearly and quickly distinguish the position of the ball and the initial direction of travel.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A golf putter had configured for assisting a golfer to improve his/her stance/setup by improving consistency of his/her eye, hand and putter head position while aligning a putt. The golf putter head of the present invention is illustrated at 10 in the figures. The golf putter head 10 further provides an improved depth perception, assisting the golfer in better determining the distance to the hole 60 in order to better estimate the length of the backswing and follow-through, as well as the strength of the swing in order to reach the hole 60. The configuration of the golf putter head 10 assists in reducing tension of the golfer by illustrating the size disparity between a golf ball 68 and the hole 60.

Figure 1:
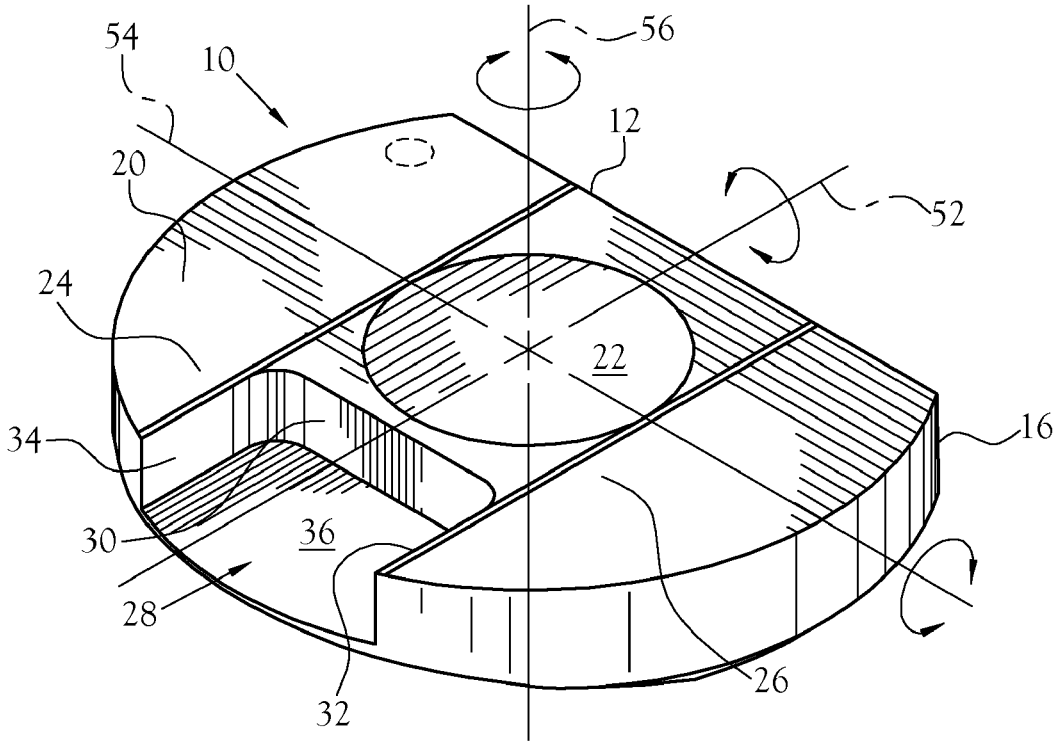
FIG. 1 is a perspective view of the top of a golf putter head constructed in accordance with several features of the present invention.
Figure 5:
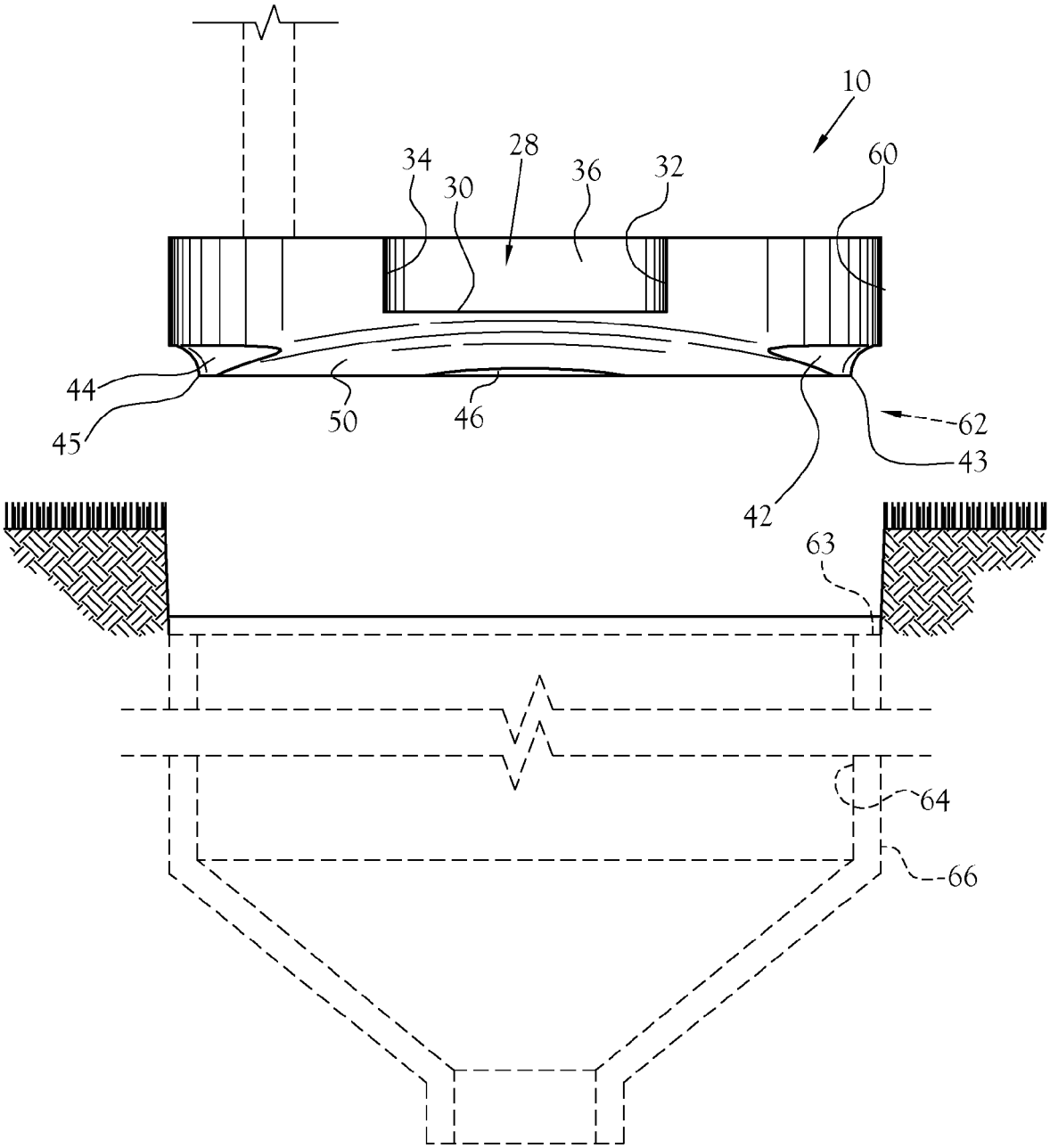
FIG. 5 is a rear elevation view of the golf putter head of FIG. 1 showing the golf putter head received within a hole and above a cup.

FIG. 1 illustrate top and bottom perspective views of a golf putter head 10 of the present invention. The golf putter head 10 defines a striking face 12 and a trailing edge 18. The golf putter head 10 defines a longitudinal axis 52 perpendicular to the striking face 12, a transverse axis 54 parallel to the striking face 12, and a vertical axis 56. The trailing edge 18 defines a circular configuration (best illustrated in FIG. 3) such that it extends from either end 14,16 of the striking face 12. The golf putter head 10 is dimensioned to closely simulate the size of a regulation-sized golf cup 62, as best illustrated in FIG. 5. In the preferred embodiment, the diameter of the golf putter head 10 is approximately the diameter of the hole 60 in order to illustrate the size disparity between the diameter of the ball 68 and the hole 60, as will be discussed further below. However, it will be understood that the golf putter head 10 may be dimensioned to be received within a golf cup 62 within the scope of the present invention.

Figure 2:
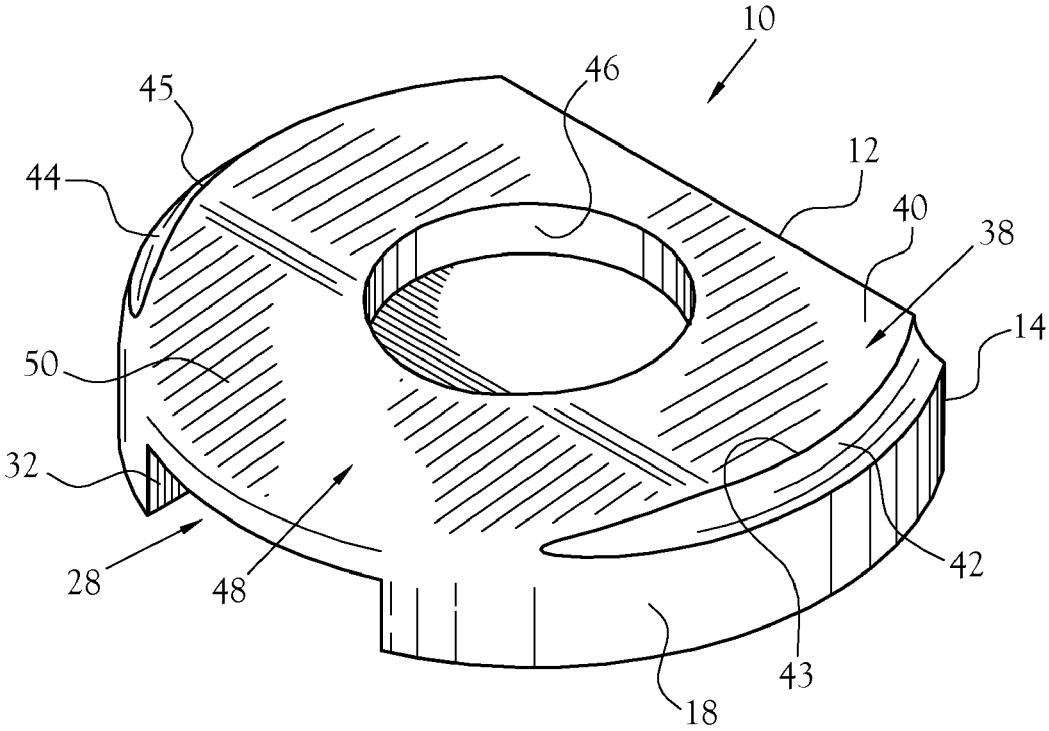
FIG. 2 is a perspective view of the bottom of the golf putter head of FIG. 1.
Figure 4:
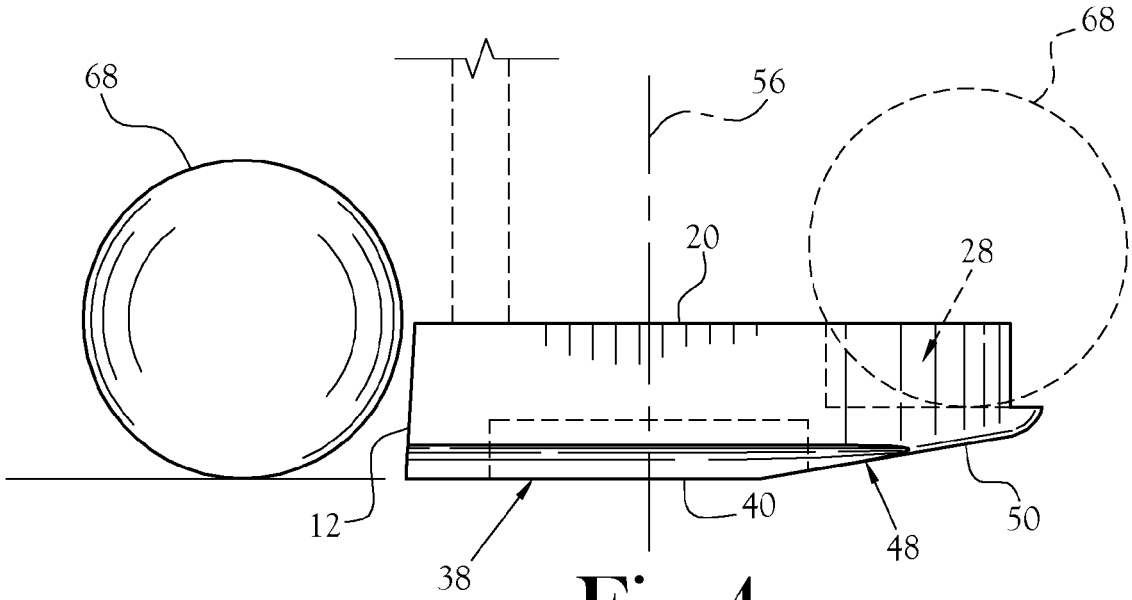
FIG. 4 is a side elevation view of the golf putter head of FIG. 1.

As illustrated in FIGS. 2 and 4, the golf putter head 10 defines a medial portion 38 having a bottom surface 40 that is substantially planar from the striking face 12 and extending toward a heel portion 48. As best illustrated in FIG. 4, the bottom surface 50 of the heel portion 48 defines a relief such that as the golf putter head 10 is moved through a stroke, the heel portion 48 does not engage the putting surface.

As illustrated in FIG. 2, a recessed portion 46 is defined in the bottom surface 40 of the medial portion 38 of the golf putter head 10. The recessed portion 46 is configured to assist in the achieving a greater heel/toe weighting of the golf putter head 10, as well as to optimize the moment of inertia of the golf putter head 10. However, it will be understood that neither the recessed portion 46, nor its specific configuration, is required within the scope of the present invention. Further, while the recessed portion 46 is not illustrated as being configured for retrieving and holding a golf ball 68, it will be understood that the recessed portion 46 can be so configured within the scope of the present invention. Specifically, the recessed portion 46 may be adapted to retrieve and contain a golf ball 68 from a putting or other surface regardless of the size of the golf putter head 10.

Figure 3:
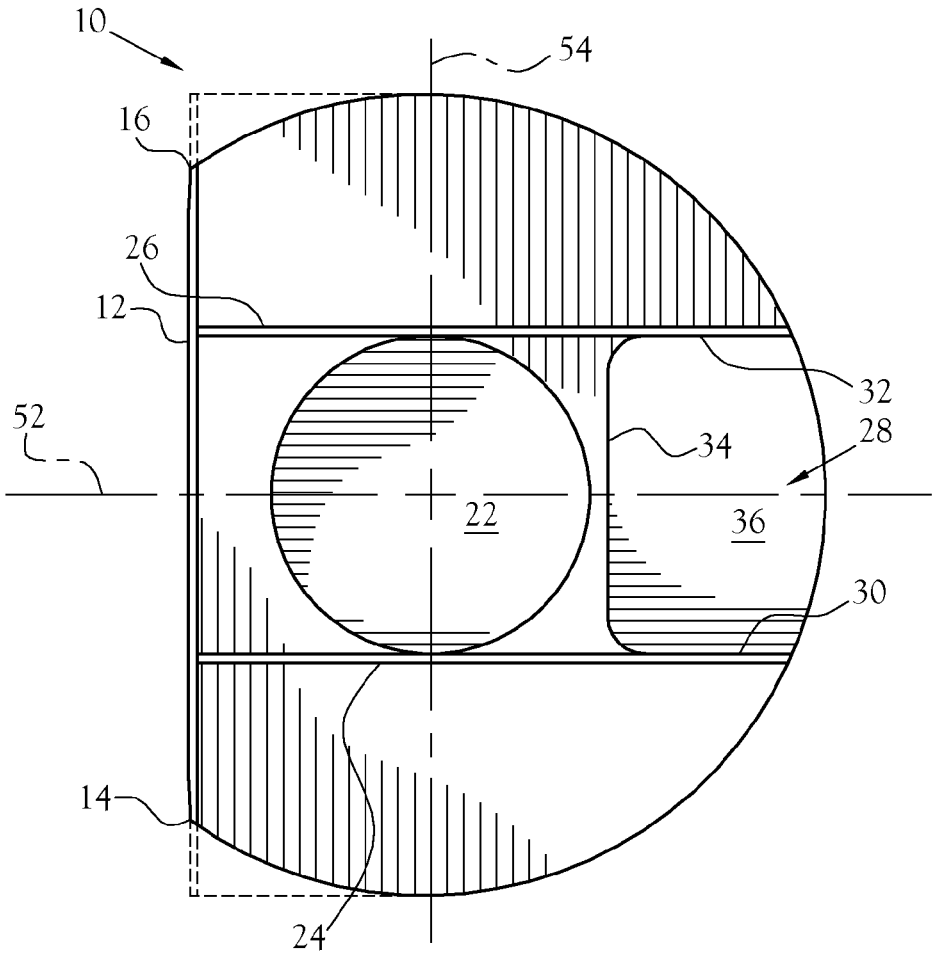
FIG. 3 is a top plan view of the golf putter head of FIG. 1, shown from a vantage whereby the golfer's head is properly aligned above the golf putter head.

As illustrated in FIGS. 3-5, the lower perimeter of the golf putter head 10 defines a radial groove 42,44 having an inner diameter 43,45 which, in the preferred embodiment, is smaller than the inside diameter 64 of a golf cup 62. This configuration is provided for display purposes in a retail setting, in order to illustrate the size of the golf putter head 10 relative to regulation hole 60. The radial groove 42,44 is thus configured to receive the upper lip 63 of the golf cup 62. Because the bottom surface 50 of the heel portion 48 defines a relief, the radial groove 42,44 of the preferred embodiment is defined by a first radial groove 42 and a second radial groove 44, each disposed on opposing sides of the striking face 12.

The golf putter head 10 defines a substantially horizontal planar top surface 20. The trailing edge of the top surface 20 defines a substantially rectangular recess 28. The recess 28 is defined by substantially vertical sidewalls 30,32,34 and a substantially horizontal bottom wall 36. The sidewalls include a first side wall 30 disposed substantially parallel to the striking face 12. Second and third side walls 32,34 are disposed substantially orthogonal to the first side wall 30. The first side wall 30 is spaced from the striking face 12 such that when a golfer is addressing a ball 68 to be struck, the line of sight from the golfer's trailing eye is substantially co-planar with the first side wall 30. The second and third side walls 32,34 are positioned with respect to center of the golf putter head 10 such that when the golfer is addressing the ball, the line of sight from the golfer's trailing eye is also substantially co-planar with and centered between the second and third side walls 32,34.

For purposes of establishing a benchmark, a "neutral" setup/stance is defined as when the golf putter head 10 is positioned next to the ball 68 to be struck, with the bottom surface 50 of the golf putter head 10 resting on the ground or being disposed substantially parallel thereto, and when the golfer is in a stance whereby the first, second and third side walls 30,32,34 each substantially "disappear." While a neutral setup/stance will make the first, second and third side walls 30,32,34 disappear, it will be understood that a particular golfer may be more comfortable in a different stance, and the first, second and third side walls 30,32,34 assist the golfer in finding a consistent setup/stance. Once a golfer establishes a comfortable setup/stance, the first, second and third side walls 30,32,34 will either reveal whether an adjustment to the club (i.e., change in shaft length or angle with respect to the golf putter head 10) would be useful, or will reveal to the golfer the relative orientation of the golf putter head 10 in order to maintain a consistent setup/stance. While FIG. 3 illustrates the view of the golf putter head 10 of the present invention when a golfer is in a neutral stance as described above, FIGS. 3A and 3B illustrate two examples of non-neutral stances/setups.

As indicated by broken lines, the terminal ends of the trailing edge 18 may be parallel to each other and perpendicular to the striking face 12. In this configuration, the striking face 12 more closely simulates the diameter of the golf cup 62 to give the golfer a better idea of the size of the target.

Figure 3A:
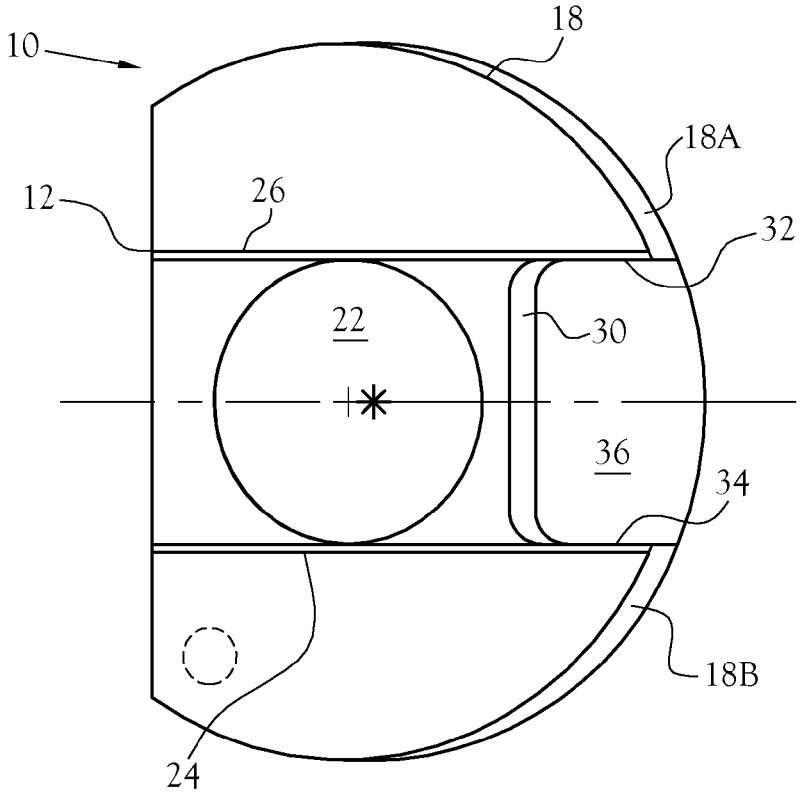
FIG. 3A is a top plan view of the golf putter head of FIG. 1, shown from a vantage whereby the golfer's head is misaligned to the right above the golf putter head.
Figure 3B:
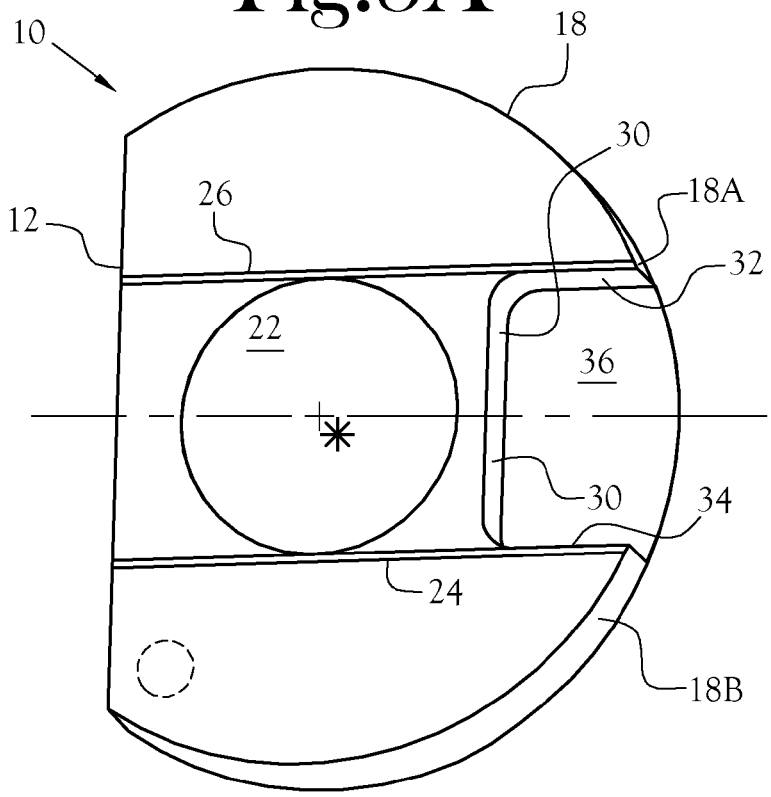
FIG. 3B is a top plan view of the golf putter head of FIG. 1, shown from a vantage whereby the golfer's head is misaligned to the right above the golf putter head and behind the golf ball.

In FIG. 3A, while the golfer has positioned his/her head above the golf putter head 10 with respect to the line of travel of the golf ball 68 once struck, because the first side wall 30 is visible, it is readily noticed that the golfer has his/her eyes positioned behind the center of the club. In this view, portions 18A and 18B of the trailing edge 18 are visible to the golfer. In FIG. 3B, the golfer now has his/her head below the travel path of the golf ball 68, which is evidence by the visible portion of the second side wall 34. Further, while in this stance, more of the trailing edge portion 18B and less of the trailing edge portion 18A is visible. In order to move into a neutral stance, the golfer must either adjust his/her stance or adjust the angle of the club shaft until each of the first, second and third side walls 30,32,34 disappear from sight. In adjusting the golfer's stance, the golf putter head 10 may be manipulated about one or more of the longitudinal, lateral or vertical axes 52,54,56 defined by the golf putter head 10. As discussed, while not in a "neutral" stance, the golfer may be a comfortable stance for that golfer. In that situation, the visual cues provided by the side walls 30,32,34 and trailing edge portions 18A,18B allow the golfer to maintain a consistent stance. It will be understood by those skilled in the art that the combination of the side walls 30,32,34 and trailing edge portions 18A,18B provide ready visual clues as to whether the toe is up or down, and as to whether the face is up or down.

It will be understood that the side walls 30,32,34 and trailing edge portions 18A,18B may be disposed at other than a right angle with respect to the bottom wall 40. In this embodiment, although not illustrated, it will be understood that the neutral stance is accomplished by standing above the golf putter head 10 such that the perceived width of each of the first, second and third side walls 30,32,34 is equal to each other, and that the trailing edge portions 18A,18B are equal to each other, assuming that each is disposed at the same angle with respect to vertical, and that each defines the same height. If such assumptions are not true, it will be understood that a user must train his/her visual perception of the first, second and third side walls 30,32,34 and trailing edge portions 18A, 18B in order to learn a proper stance with relation to the golf putter head 10.

In order to better accentuate the effect of the recess 28, the top surface 20 of the golf putter head 10 and the horizontal bottom wall 36 may be painted or coated a first color, while the first, second and third side walls 30,32,34 are painted or coated a second contrasting color. However, it will be understood that a single color may be used within the scope of the present invention.

In addition to the visual perception created by the first, second and third side walls 30,32,34 of the substantially rectangular recess 28, the recess 28 further provides the ability to retrieve a ball 68 lying on the green, as illustrated in phantom in FIG. 4.

Ball alignment indicia are provided on the top surface 20 of the golf putter head 10. Illustrated are a circular indicium 22 and first and second linear indicia 24,26. The circular indicium 22 is illustrated as being concentric with the golf putter head 10 and as defining a diameter closely simulating the diameter of a conventional golf ball 68. It will be understood, however, that the size and disposition of the circular indicia 22 may be other than that illustrated and fall within the scope of the present invention. The circular indicium 22, in cooperation with the size of the golf putter head 10, serves to illustrate for the golfer the disparity in size between the golf ball 68 and the hole 60. Specifically, because the hole 60 is often perceived to be smaller than its actual size as the golfer moves away from the hole 60, the size of the golf putter head 10 serves to immediately remind the golfer of the size of the target at which he/she is aiming. Further, because the circular indicium 22 is the same size as a golf ball 68, it serves to illustrate the difference in size such that the golfer can mentally see the target.

The relationship established between the circular indicium 22 and the size of the golf putter head 10 further serves to improve the depth perception of the golfer. Especially with practice, a golfer can train his/her eye to recognize the visual difference in size between the hole 60 at a distance and the golf putter head 10 in order to better estimate the distance between the golf ball 68 and the hole 60. With an accurate determination of this distance, the golfer is better able to determine the required stroke.

The linear indicia 24,26 cooperate to define upper and lower limits of a path of travel of the golf ball 68. While the lie of the ball 68 typically requires something other than a straight shot to the hole 60, the linear indicia 24,26 assists the golfer in directing the ball 68 through the initial direction of the ball travel. The linear indicia 24,26 define a visual path having a width of approximately that of a ball 68, as opposed to a line as typically imagined by the golfer. The linear indicia 24,26 are closely spaced apart from the circular indicium 22 in order to limit the visual margin of error in aligning the stroke. Further, the linear indicia 24,26 serve as a sight for correcting a consistently left or right shot. Specifically, for a shot consistently missing one direction or the other, the golfer may visually align his/her eyes with the appropriate one of the linear indicia 24,26, with the ball 68 remaining centered between the linear indicia 24,26, thus changing the visual perception of the alignment of the golf ball 68 with respect to the hole 60.

In the preferred embodiment, the color of the golf putter head 10 contrasts with the color of the circular indicium 22 and the linear indicia 24,26. Accordingly, the golfer is provided a means to clearly and quickly distinguish the position of the ball 68 and the initial direction of travel. However, it will be understood that the contrasting colors are not required in order to fall within the scope of the present invention.

The dimension of the golf putter head 10, the circular indicium 22 and the linear indicia 24,26 cooperate to synchronize the hole 60, golf putter head 10, the path of the ball 68, and size disparity between the ball 68 and hole 60 in order to relieve tension in the golfer.

From the foregoing description, it will be recognized by those skilled in the art that a golf putter head dimensioned to closely simulate the size of a regulation-sized golf hole has been disclosed. The golf putter head includes at least an indicium approximating the size of a golf ball, whereby a golfer is presented with a visual representation of the size of the target at which he/she is aiming. The golf putter head further includes indicia for indicating a direction of initial travel of the ball. Further, the golf putter head includes three-dimensional indicia to assist the golfer in properly aligning his/her eyes and hands with respect to the golf putter head while addressing the golf ball to be struck.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. A golf putter head for assisting a golfer comprising:

a striking face defining a first end and a second end;

a top surface;

vertical alignment indicia for assisting a golfer in aligning his/her head above said golf putter head, said vertical alignment indicia defined by a recess in said top surface, said recess including at least a first side wall disposed substantially parallel to said striking face and second and third side walls disposed substantially orthogonal to said first side wall, said first, second and third side walls being disposed substantially perpendicular to said top surface, whereby said first, second and third side walls substantially disappear from a golfer's view with the golfer is in a neutral stance above said golf putter head;

a trailing edge extending from said striking face first end to said striking face second end, said top surface being bounded by said striking face and said trailing edge, at least a portion of said trailing edge defining a substantially circular configuration and being dimensioned to closely simulate the diameter of a golf hole; and indicia disposed on said top surface, said indicia including at least a circular indicium disposed substantially concentric with said trailing edge, said circular indicium defining a diameter closely simulating the diameter of a golf ball, whereby said circular indicium cooperates with said golf putter head to illustrate for the golfer the relative size of the golf ball with respect to the hole.

2. The golf putter head of claim 1 wherein said indicia further includes linear indicia including a first linear indicium and a second linear indicium, said circular indicia being disposed between said first and second linear indicia, said first and second linear indicia extending orthogonally from said striking face, whereby said first and second linear indicia cooperate to define upper and lower limits of an initial path of travel of the golf ball.

3. A golf putter head for assisting a golfer comprising:

a striking face defining a first end and a second end;

a trailing edge extending from said striking face first end to said striking face second end, at least a portion of said trailing edge defining a substantially circular configuration and being dimensioned to closely simulate the diameter of a golf hole;

a top surface bounded by said striking face and said trailing edge; and vertical alignment indicia for assisting a golfer in aligning his/her head above said golf putter head, said vertical alignment indicia defined by a recess in said top surface, said recess including at least a first side wall disposed substantially parallel to said striking face and second and third side walls disposed substantially orthogonal to said first side wall, said first, second and third side walls being disposed substantially perpendicular to said top surface, whereby said first, second and third side walls substantially disappear from a golfer's view with the golfer is in a neutral stance above said golf putter head; and indicia disposed on said top surface, said indicia including at least a circular indicium disposed substantially concentric with said trailing edge, said circular indicium defining a diameter closely simulating the diameter of a golf ball, whereby said circular indicium cooperates with said golf putter head to illustrate for the golfer the disparity between the relative size of the golf ball with respect to the hole.

4. The golf putter head of claim 3 wherein said indicia further includes linear indicia including a first linear indicium and a second linear indicium, said circular indicia being disposed between said first and second linear indicia, said first and second linear indicia extending orthogonally from said striking face, whereby said first and second linear indicia cooperate to define upper and lower limits of an initial path of travel of the golf ball.

* * * * *